US012796762B2

(12) United States Patent
Storey et al.

(10) Patent No.: US 12,796,762 B2
(45) Date of Patent: Nov. 17, 2026

(54) HELMET

(71) Applicant: George TFE SCP, Monaco (MC)

(72) Inventors: Piers Christian Storey, Monaco (MC); John George Lloyd, Monaco (MC)

(73) Assignee: GEORGE TFE SCP, Monaco (MC)

( * ) Notice: Subject to any disclaimer, the term of this patent is extended or adjusted under 35 U.S.C. 154(b) by 0 days.

(21) Appl. No.: 19/157,363

(22) PCT Filed: Mar. 8, 2024

(86) PCT No.: PCT/IB2024/052265
§ 371 (c)(1),
(2) Date: Aug. 17, 2025

(87) PCT Pub. No.: WO2024/189394
PCT Pub. Date: Sep. 19, 2024

(65) Prior Publication Data

US 2026/0114534 A1 Apr. 30, 2026

(30) Foreign Application Priority Data

Mar. 10, 2023 (WO) ..... PCT/IB2023/052323

(51) Int. Cl.
*A42B 3/06* (2006.01)
*A42B 3/12* (2006.01)
*A42B 3/28* (2006.01)

(52) U.S. Cl.
CPC ..... *A42B 3/064* (2013.01); *A42B 3/124* (2013.01); *A42B 3/128* (2013.01); *A42B 3/283* (2013.01)

(58) Field of Classification Search
CPC ..... A42B 3/064; A42B 3/124; A42B 3/128; A42B 3/283
See application file for complete search history.

(56) References Cited

U.S. PATENT DOCUMENTS

| | | | | |
|---|---|---|---|---|
| 5,309,576 | A * | 5/1994 | Broersma | A42B 3/128 2/412 |
| 5,937,446 | A | 8/1999 | Fallert | |
| 10,736,373 | B2 | 8/2020 | Chilson et al. | |
| 10,834,987 | B1 | 11/2020 | Bottlang et al. | |
| 2006/0031978 | A1 * | 2/2006 | Pierce | A42B 3/283 2/414 |
| 2015/0047110 | A1 | 2/2015 | Sarl | |
| 2019/0231018 | A1 * | 8/2019 | Boutin | A42B 3/124 |
| 2021/0015195 | A1 | 1/2021 | Chilson | |
| 2022/0232924 | A1 * | 7/2022 | Cook | A42B 3/32 |
| 2023/0010873 | A1 * | 1/2023 | Storey | A42B 3/124 |
| 2023/0011532 | A1 | 1/2023 | Storey | |
| 2024/0032639 | A1 * | 2/2024 | Storey | A42B 3/12 |

FOREIGN PATENT DOCUMENTS

| | | | |
|---|---|---|---|
| EP | 3473122 | A1 | 4/2019 |
| WO | 2008085108 | A1 | 7/2008 |

* cited by examiner

*Primary Examiner* — Clinton T Ostrup
(74) *Attorney, Agent, or Firm* — Jason L DeFrancesco

(57) ABSTRACT

Helmet (1) comprising: at least a cellular energy-absorbing insert (2); a foam liner (3) comprising at least one recess (4) shaped to accommodate the at least one cellular energy-absorbing insert (2); the foam liner (3) also comprises at least one vent (6) for allowing an air transit from outside the helmet (1) to the cellular energy-absorbing insert (2); wherein the at least one vent (6) is partially closed such that the at least one cellular energy-absorbing insert (2) is not visible from outside the helmet (1) through the vent (6).

12 Claims, 3 Drawing Sheets

HELMET

This application claims priority to PCT Application No. PCT/IB2023/052323, filed Mar. 10, 2023, entitled "Helmet".

TECHNICAL FIELD

The present invention relates to the field of helmets with cellular energy-absorbing structures. In particular, the present invention relates to helmets using layered structures.

BACKGROUND ART

In the state of the art some helmet solutions using cellular energy-absorbing structures are known. These kinds of structures have excellent properties in terms of impact energy absorption with respect to traditional polymeric foam materials. Despite this, the foam allows to obtain fascinating shapes and is still easier to mould with respect to the cellular structures. Therefore, many solutions employing these kinds of energy-absorbing structures combine the use of foam liners and cellular structures.

An example in this sense is disclosed in the patent U.S. Pat. No. 10,834,987. This document relates to a helmet comprising a plurality of cellular liners that are retained within respective recesses of a polymer foam shell without the necessity of using additional fasteners or adhesive. Substantially, the cellular liner of this document is sized to fit snug within the recess. Despite the cellular liner being retained in the foam shell, during an oblique impact to the helmet, the cellular liner tends to slide over a barrier layer attached to the polymer shell and simultaneously it in-plane compresses. When the cellular liner crosses an air vent of the foam liner, the cells of the cellular liner tend to enter inside it and to get stuck into the vent, thus increasing the risk of a brain torque in the wearer. Indeed, the sliding of the cellular liner can abruptly interrupt, with serious implications in term of safety for the wearer.

The patent EP3473122B1 partially solves this problem through vent openings that are chamfered to allow an energy absorbing insert in a cycling helmet to not stop in a vent opening and to slide with a limited restriction.

The patent U.S. Pat. No. 10,736,373B2 describes how the vents, in a helmet comprising a foam liner and cellular inserts, can be arranged with respect to the recesses in which the cellular inserts are retained. This document does not refer to the interaction between vent and cellular insert during an impact.

A further solution is known in the state of the art and described in the document WO2008085108A1. In this solution, the air vents of the helmet are blind holes. The air passages in the helmet of this solution are branched to avoid pass-through holes in the helmet, which make the helmet less safe to penetration.

The document U.S. Pat. No. 5,937,446A describes a helmet having a dual layer outer shell, which partially cover the vents from outside, while permitting an incoming air flow through the vents. The document U.S. Pat. No. 10,834,987B1 describes a helmet having a plastic film arranged inside a cavity of the helmet that is completely open in correspondence of ventilation openings that run through the helmet from outside to inside.

SUMMARY

Said and other drawbacks of the state of the art are now solved by a helmet comprising: at least a cellular energy-absorbing insert; a foam liner comprising at least one recess shaped to accommodate the at least one cellular energy-absorbing insert. The foam liner also comprises at least one vent for allowing an air transit from outside the helmet to the cellular energy-absorbing insert. The at least one vent is partially closed such that the at least one cellular energy-absorbing insert is not visible from outside the helmet through the vent. The partial closure of the vent allows to reduce the airflow. In this manner the air transit is limited and controlled for making the helmet more comfortable during the cold season. Moreover, being the cellular energy-absorbing insert not visible from outside, the external aspect of the helmet is beautified and more uniform. Furthermore, a closed vent allows to achieve higher performance in penetration safety. In an alternative version, the vents are closed and the transit of air through the vent/s is prevented. The helmet manufacturer can thus mould only one type of foam liner and can use it for both not-ventilated, partially ventilated or ventilated helmets, allowing to diversify offer while keeping manufacturing costs low.

Advantageously, the cellular energy-absorbing insert can comprise a plurality of interconnected open cells configured to absorb energy by plastic deformation in response to a longitudinal compressive load applied to said cells. This kind of cellular material provides excellent results in terms of energy-absorption and is very light weight.

In particular, each cell can comprise a tube having a sidewall/s and a longitudinal axis, and the cells are connected to each other through their sidewalls. This feature enables the production of a sheet of interconnected side-by-side cells.

Advantageously, the helmet can comprise a protective layer attached to the foam liner in correspondence of bottom/s of said recess/es. The protecting layer contributes to facilitate the relative sliding of cellular energy-absorbing insert over the foam liner and to prevent the cellular energy-absorbing insert to sink in the foam liner.

In particular, the protective layer can be also attached to sidewall/s of said recess/es. In this manner even the insertion/extraction of the cellular energy-absorbing insert, during assembly or disassembly, is facilitated.

Preferably, the protective layer can be a sheet layered over the recess of the foam liner. It can be a coating sprayed over the inner surface/s of the recess. Alternatively, it can be a film that can be easily attached, for example with an adhesive, to the bottom of the recess.

Advantageously, the protective layer can cross the at least one vent, protecting the wearer's head from any object that can enter in the air vent. Moreover, a continuous protective layer that closes the vent/s allows a sliding of the cellular energy-absorbing insert relative to the foam liner without the risk that cells of the cellular insert jam in the vent. The continuous protective layer prevents air entering in the vent to reach the wearer's head.

Preferably, the protective layer can be permeable to air. In particular, the protective layer can comprise micro-holes in correspondence of the at least one vent. In this way, air can transit through the protective layer in a limited way.

The helmet can also comprise at least one plug shaped to fill, at least in part, the air vent. The plug closes the air vent improving the performance of the helmet in term of penetration. Moreover, being the vent/s closed, the risk that the cellular energy-absorbing insert enters and stop in the vent/s is prevented.

In particular, the plug can comprise at least one air channel through which the air can transit from outside the helmet to the cellular energy-absorbing insert. The air channel allows an air transit from outside to inside the helmet, thus a ventilation of the wearer's head.

Preferably, the at least one air channel is shaped to laterally divert the air. This feature allows to redirect the airflow passaging through the air vent over a wider area of the cellular energy-absorbing insert.

Alternatively, the plug is shaped so as to form air passages with the foam liner through which the air can transit from outside the helmet to the cellular energy-absorbing insert. This kind of plug allows to protect the wearer's head from sharp object that can enter in the vent.

Advantageously, the cellular energy-absorbing insert can have synclastic properties. This feature makes the cellular energy-absorbing insert spherically deformable without distortion of cells. In this way, the cellular energy-absorbing insert can be realized as a flat sheet that is subsequently curved and inserted in the recess.

Preferably, the cellular energy-absorbing insert can be configured to provide an improved shock absorbing protection as compared with the foam liner. The cellular energy-absorbing insert has higher performance in term of energy absorption than the foam liner. Moreover, being independent from the foam liner, the cellular energy-absorbing insert can be arranged in specific areas of the helmet for improving the protection of certain parts of the wearer's head.

In particular, the foam liner can be made of a polymeric expanded foam. This material makes the foam liner easy to be manufactured and moulded.

These and other advantages will be better understood thanks to the following description of different embodiments of said invention given as non-limitative examples thereof, making reference to the annexed drawings.

DRAWINGS DESCRIPTION

DETAILED DESCRIPTION

Figure 1:
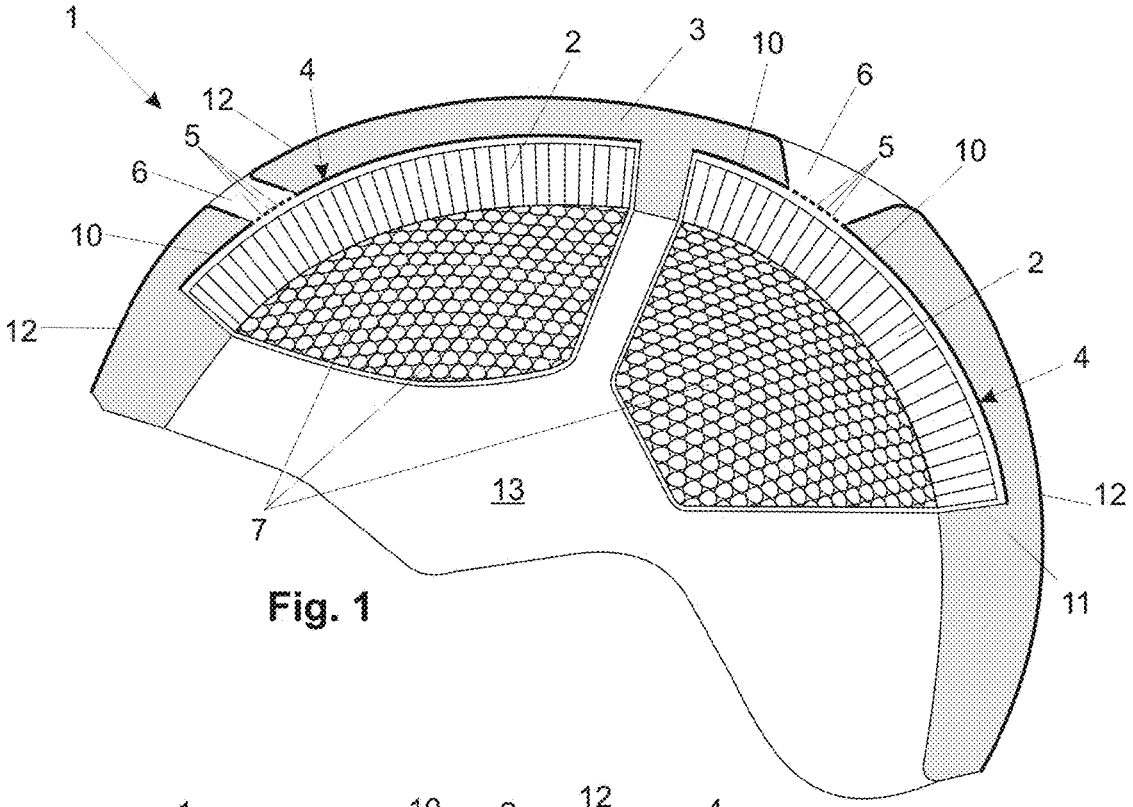
FIG. 1 shows a schematic cross-sectional view of a helmet according to a first embodiment of the present invention.

The following description of one or more embodiments of the invention refers to the annexed drawings. The same reference numbers indicate equal or similar parts. The object of the protection is defined by the annexed claims. Technical details, structures or characteristics of the solutions herebelow described can be combined with each other in any suitable way.

In the following the term "cellular energy-absorbing insert" can be abbreviated with the term "cellular insert".

With the reference number 1 is represented a helmet according to the present invention.

The helmet 1 comprises an outer foam liner 3, preferably made of a polymeric expanded foam like EPS or EPP. The helmet 1 also comprises one or more cellular inserts 2 arranged in respective recesses 4 of the foam liner 2. The helmet 1 depicted in FIGS. 1,4 comprises more cellular inserts 2, while the helmet 1 depicted in FIGS. 2,3 comprises one cellular insert 2.

Terms "outer" and "inner" refer to an ideal direction that goes from the cavity 13 of the helmet 1 wherein the head of the wearer can be positioned to the outside of the helmet 1.

Each recess 4 is shaped so as to hold a respective cellular insert 2. To make it possible, the outer face of the cellular insert 2 is larger than the inner face of the cellular insert 2 and the mouth of the recess 4 is stricter than the bottom of the recess 4. Moreover, the shape of the recess 4 is substantially complementary to the shape of the corresponding cellular insert 2, as shown in FIGS. 1,2,3,4.

The foam liner 3 comprises vents 6, thus passages that extend through the foam liner's thickness, that can allow air to enter into the helmet 1, as shown in FIGS. 1,2,3,4.

The cellular insert 2 is made of a plurality of interconnected open cells 7. These cells 7 are configured to absorb energy by plastic deformation in response to a longitudinal compressive load, thus an out-of-plane compression.

Each cell 7 creates a tube having a sidewall and a longitudinal axis. Through each cell 7 an airflow can transit in a direction concurrent with the longitudinal axis.

The cells 7 are interconnected via their sidewalls 8. A bonding agent can keep the cells 7 joined together. The cells 7 can be welded to each other via a partial melting of their sidewalls 8. Alternatively, the cells 7 can be bonded by means of adhesive layers (not shown) interposed between adjacent sidewalls 8.

Figure 5:
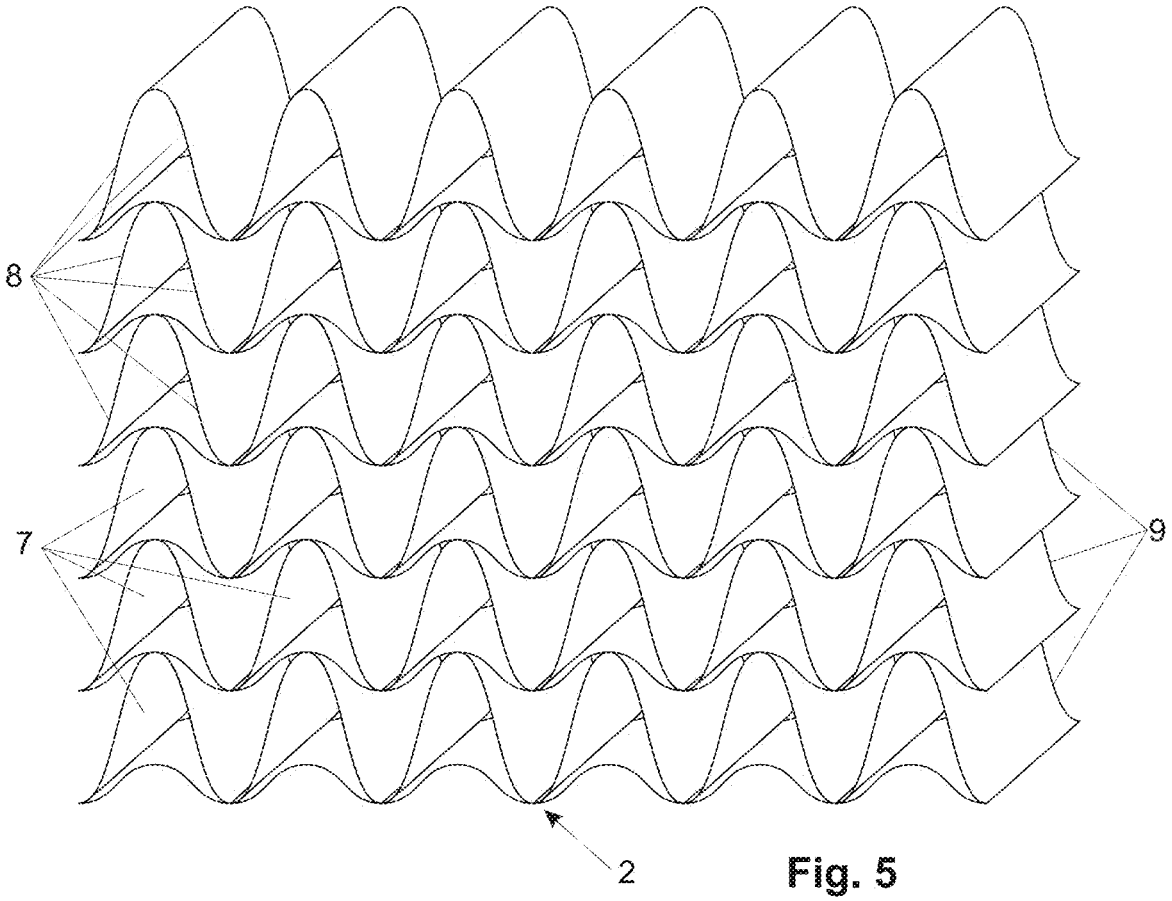
FIG. 5 shows an isometric view of a first type of cellular energy-absorbing insert according to the present invention.
Figure 6:
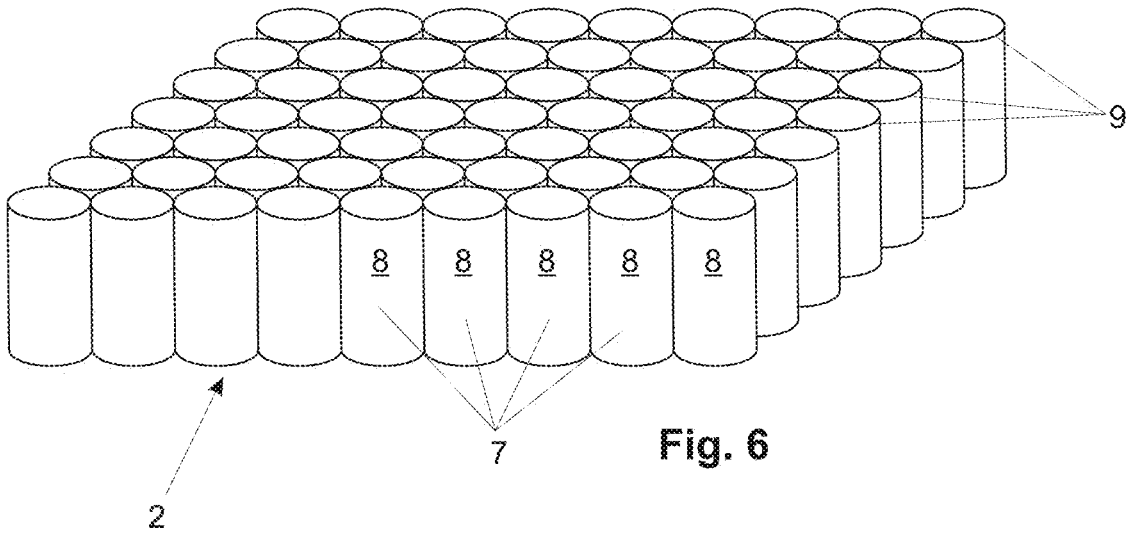
FIG. 6 shows an isometric view of a second type of cellular energy-absorbing insert according to the present invention.

The cellular insert 2 can be realized from a flat sheet of interconnected cells 7 that subsequently is curved. The flat sheet of cells 7, as shown in FIGS. 5,6, is like a tile/brick of interconnected cells 7 having parallel longitudinal axes. For obtaining the shape of the cellular insert 2, the flat sheet is firstly cut according to a specific shape and secondly is curved. The flat sheet has normally a constant thickness.

The flat sheet of cells 7 can be curved via thermoforming or manually if it has synclastic properties. The flat sheet of cells 7 of FIGS. 5,6 can thus assume a single-curved shape or a double-curved shape.

Figure 4:
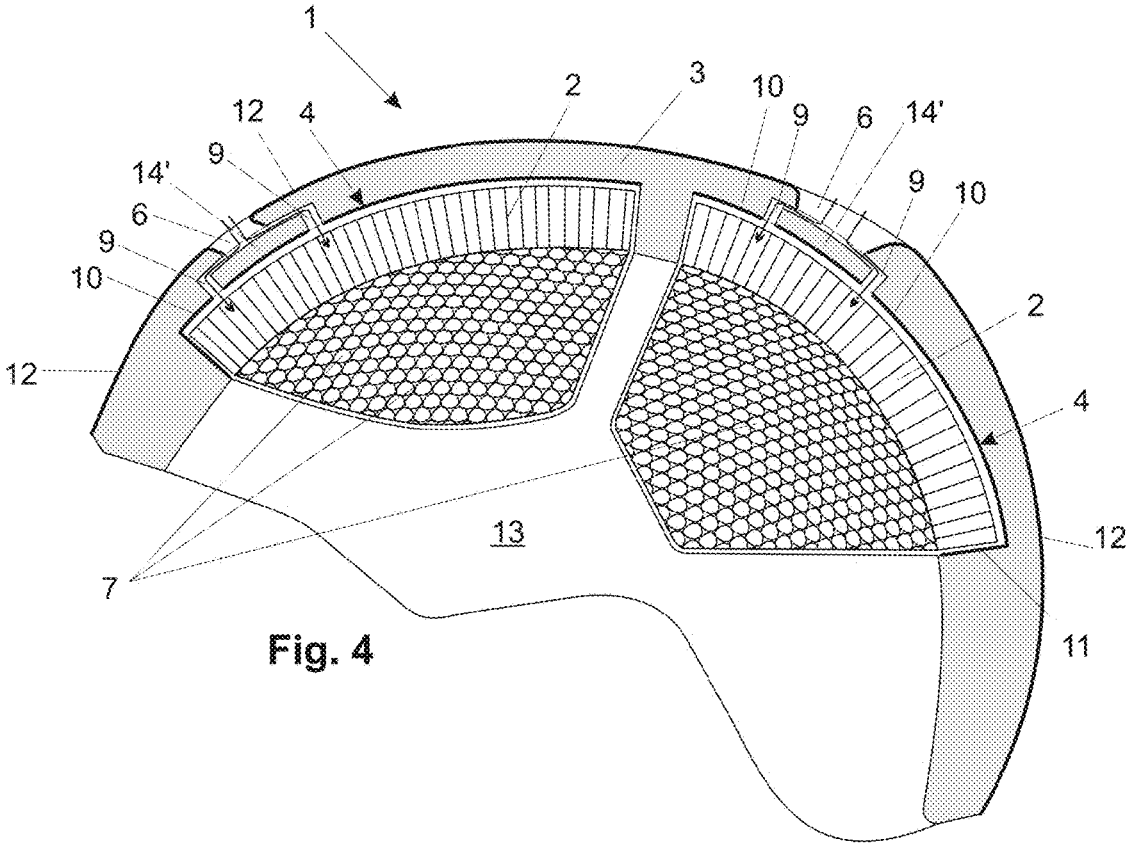
FIG. 4 shows a schematic cross-sectional view of a helmet according to a third embodiment of the present invention.

The cells 7 can be cylindrical tubes, as in FIGS. 1,4,6. The tubes depicted in FIGS. 1,4,6 have a circular cross-section. Alternatively, cells 7 can comprise sidewalls 8 bonded together to form tubes having other shapes. In particular, the cross-section of the cells/tubes 7 can be a square, a hexagon, a non-uniform hexagon, a re-entrant hexagon, a chiral truss, a diamond, a triangle.

Figure 2:
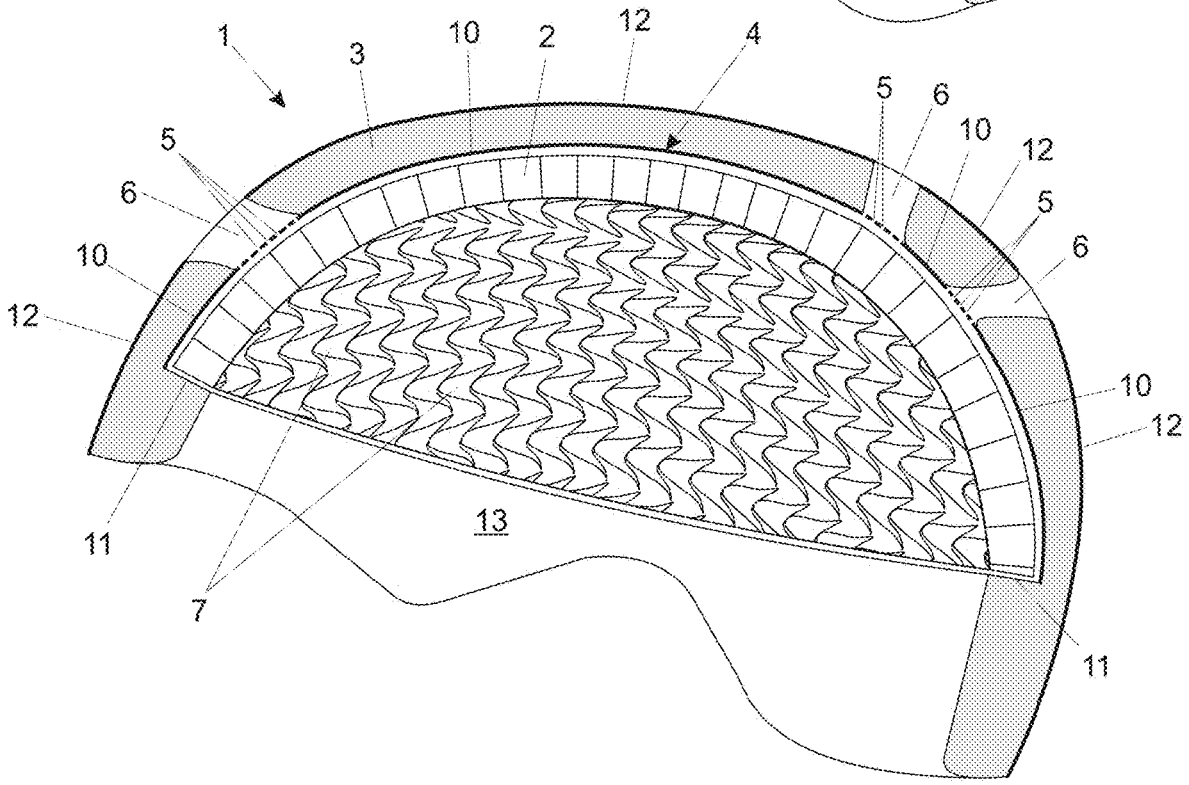
FIG. 2 shows a schematic cross-sectional view of another helmet according to a first embodiment of the present invention.
Figure 3:
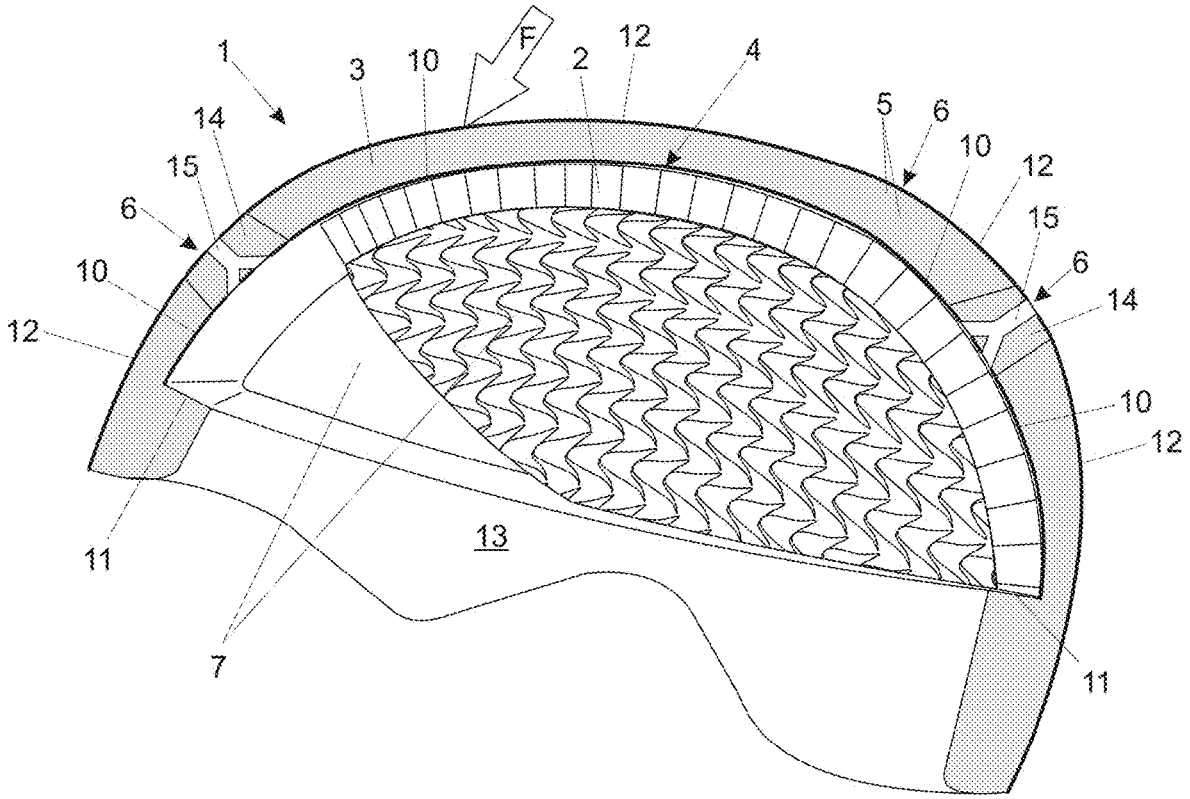
FIG. 3 shows a schematic cross-sectional view of a helmet according to a second embodiment of the present invention.

In the example of FIGS. 2,3,5, the cells 7 have an arrowhead shape. This kind of shape of cells 7 exhibits synclastic properties. Therefore, the sheet of cells 7 can be spherically curved with hands. Vice versa, the cylindrical cells 7 do not exhibit synclastic properties, therefore the curved shape of the cellular insert 2 is achieved by thermoforming the flat sheet.

The thickness of the sheet of cells 7 from which the cellular insert 2 is obtained can be between 15 and 40 mm.

When the cells 7 have a circular cross-section, the outer diameter of the circular cross-section can range between 2.5 and 8 mm, and the wall thickness of said cells 7 can range between 0.05 and 0.3 mm. According to these dimensional values, the energy absorption and the weight of cellular insert 2 is optimized.

The helmet 1 can also comprise a protective layer 10 arranged on the inner surface of the foam liner 3. In particular, the protective layer 10 is arranged on the surface of the recess 4.

The protective layer 10 can be a film attached, or otherwise layered, to the bottom of the recesses 4, as schematically depicted in FIGS. 1,2,3. Alternatively, the protective layer 10 can be a coating sprayed, or otherwise distributed, over the inner surface of the recess 4, as schematically depicted in FIG. 4. In the latter case, the protective layer 10 covers both the bottom and the sidewalls 11 of the recess 4.

The protective layer 10 can be made of a low-friction material, like PTFE, polycarbonate or polyamide, for facilitating a relative translation between the cellular insert 2 and the foam liner 3.

When a helmet 1 undergoes an oblique impact, the cellular insert 2 tends to slide over the protective layer 10, as shown in FIG. 3. The term "oblique impact" means an impact comprising both a normal component and a tangential component. Terms "normal" and "tangential" make reference to the outer surface of the helmet 1.

When the helmet 1 impacts an object, the helmet 1 is subject to a load, schematically depicted with an arrow and the reference sign "F" in FIG. 3. The load F tends to rotate the helmet 1 and with it the head of the wearer, that is attached to the helmet 1 through a retaining system (not shown). Despite this, the cellular insert 2 slides over the protective layer 10 attached to the foam liner 3. Therefore, a part of the helmet 1 rotates under the load F, while the cellular insert 2 in-plane compresses absorbing the tangential component of the load F and transferring less impact energy to the wearer's head.

If an outer shell 12 is present, the vent 6 also crosses the outer shell 12.

The vents 6 can lie in correspondence of the recesses/es 4 or not. The helmet 1 can also comprise vents 6 lying outside the perimeter of the recess/es 4 (not shown). In this case, these vents run from the outer to the inner surfaces of the helmet 1.

The air enters in helmet 1 through the vent/s 6 and reaches the cellular insert 2. Being the cellular insert 2 permeable to air, in a direction that runs from outside to inside the helmet 1, the air passes through the cells 7 up to the cavity 13 for the wearer's head.

In order to limit the airflow that enters in the cavity 13, the vents 6 are partially closed. This closure of the vent/s 6 is configured so to make the cellular insert 2 non-visible from outside. This means that of each cell 7 of the cellular insert 2 is not entirely distinguishable through the vents 6 if someone observes the helmet 1 from the outside.

In a first embodiment, shown in FIGS. 1,2, the vents 6 are partially closed by means of a protective layer 10 that is micro-holed.

The protective layer 100 can extend over the bottom of recess/es 4, therefore crossing the aperture of the vent/s 6.

Micro-holes 5, thus holes of very few millimetres, are provided in correspondence of said vents 6. The air thus reaches the bottom of the vents 6, that are closed by the protective layer 10 and only a limited amount of air passes through the micro-holes 5, as shown in FIGS. 1,2.

Alternatively, the vent/s 6 can be partially closed in a different way. As shown in FIG. 3, inside the vents 6 can be arranged a plug 14 that fills the vent 6.

This plug 14 comprises one or more air channels 15. In particular, as shown in FIG. 3, the air channel 15 can have a single upstream portion and several downstream portions that branch from the upstream one. In this manner the airflow entering in the helmet 1 is split and covers a wider area of the cellular insert 2. The air channel 15 is smaller than the vent 6 and consequently the airflow is also reduced. Moreover, the angle of the air channel 15 makes the cellular insert 2 not visible from outside. Other shapes of the air channels 15 are possible and the air channel 15 can also be straight and not angled as shown in FIG. 3.

The plug 14 are preferable inserted in the vents 6 from the inner cavity 13 before the cellular insert 2 is arranged in the recess 4, so that the cellular insert 2 keeps in position the plugs 14. Alternatively, the plug 14 can be stuck in the vent 6. Otherwise, the plug 14 can be bigger than the vent 6 and made of a material that is softer than the foam of the foam liner 3. In this way, the plug 14 can be compressed and inserted in the vent 6 so that its subsequent expansion holds the plug 14 in the vent 6.

In a further embodiment shown in FIG. 4, the plug 14' fills only a part of the vent 6.

In this embodiment, the vent 6 comprises an upstream portion that is stricter than a downstream portion. The plug 14' is arranged in the downstream portion and fills it.

The plug 14' is shaped so as to create with the foam liner 3 one or more air passages 9. In FIG. 4, the plug 14' comprises some groves that, once the plug 14' is arranged in the vent 6, form said air passages 9.

In this manner, the airflow coming from outside the helmet 1 is diverted and reaches a wider area of the cellular insert 2. Moreover, the vent 6 is blind and an eventual object that enters in the vent 6 is stopped by the plug 14'.

The plug 14,14' of the embodiments of FIGS. 3,4 can comprise an inner layer, similar to the protective layer 10, for improving the relative translation between the cellular insert 2 and the foam liner 3. Moreover, the plug 14 of FIG. 3 can comprise a portion of the outer shell to camouflage with the shell 12. Even the outer surface of the plug 14' of FIG. 4 can be of the same colour or aspect of the shell 12.

This restriction of the vents 6 is particularly suitable for winter season and consequently for ski helmets. In this manner, the helmet is warmer and more comfortable during the cold season.

The protective layer 100 can extend completely or partially over the bottom of recess/es 4.

The micro-holes 5 can be microscopic holes.

Concluding, the invention so conceived is susceptible to many modifications and variations all of which fall within the scope of the inventive concept, furthermore all features can be substituted to technically equivalent alternatives. Practically, the quantities can be varied depending on the specific technical requirements. Finally, all features of previously described embodiments can be combined in any way, so as to obtain other embodiments that are not herein described for reasons of practicality and clarity.

LEGEND OF REFERENCE SIGNS

1 helmet
2 cellular energy-absorbing insert
3 foam liner
4 recess
5 micro-hole
6 vent
7 cell
8 sidewall (of cell)
9 air passage
10 protective layer
11 sidewall (of recess)
12 outer shell
13 cavity (for wearer's head)
14,14' plug
15 air channel

The invention claimed is:

1. A helmet comprising:

at least a cellular energy-absorbing insert;

a foam liner comprising at least one recess shaped to accommodate the at least one cellular energy-absorbing insert; the foam liner also comprises at least one vent for allowing an air transit from outside the helmet to the cellular energy-absorbing insert;

a protective layer, attached to the foam liner in correspondence of a bottom of said at least one recess, that crosses the at least one vent, wherein the protective layer comprises micro-holes in correspondence of said at least one vent; and wherein the at least one vent is partially closed such that the at least one cellular energy-absorbing insert is concealed from outside the helmet through the vent.

2. The helmet according to claim 1, wherein the cellular energy-absorbing insert comprises a plurality of interconnected open cells configured to absorb energy by plastic deformation in response to a longitudinal compressive load applied to said cells.

3. The helmet according to claim 2, wherein each cell comprises a tube having sidewall or sidewalls and a longitudinal axis, and the cells are connected to each other through their sidewalls.

4. The helmet according to claim 1, wherein the protective layer is also attached to a sidewall of said at least one recess.

5. The helmet according to claim 1, wherein the protective layer is a sheet layered over the at least one recess of the foam liner.

6. The helmet according to claim 1, further comprising at least one plug shaped to fill at least in part the at least one vent.

7. The helmet according to claim 6, wherein the plug comprises at least one air channel through which the air can transit from outside the helmet to the cellular energy-absorbing insert.

8. The helmet according to claim 6, wherein the at least one air channel is configured to laterally divert the air.

9. The helmet according to claim 6, wherein the plug is shaped so as to form air passages with the foam liner through which the air can transit from outside the helmet to the cellular energy-absorbing insert.

10. The helmet according to claim 1, wherein the cellular energy-absorbing insert has synclastic properties.

11. The helmet according to claim 1, wherein the cellular energy-absorbing insert is configured to provide an improved shock absorbing protection as compared with the foam liner.

12. The helmet according to claim 1, wherein the foam liner is made of a polymeric expanded foam.

* * * * *